US009559424B2

(12) United States Patent
Nelson

(10) Patent No.: US 9,559,424 B2
(45) Date of Patent: Jan. 31, 2017

(54) ANTENNA FEED WITH POLARIZATION ROTATION

(71) Applicant: ALCATEL-LUCENT, Boulogne Billancourt (FR)

(72) Inventor: James W. Nelson, Cheshire, CT (US)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/567,221

(22) Filed: Dec. 11, 2014

(65) Prior Publication Data

US 2015/0091770 A1 Apr. 2, 2015

Related U.S. Application Data

(63) Continuation of application No. 13/406,683, filed on Feb. 28, 2012, now Pat. No. 8,933,855.

(51) Int. Cl.

| | |
|---|---|
| ***H01Q 15/24*** | (2006.01) |
| ***H01Q 13/00*** | (2006.01) |
| ***H01P 1/17*** | (2006.01) |
| ***H01P 1/165*** | (2006.01) |

(52) U.S. Cl.

CPC ..... *H01Q 13/00* (2013.01); *H01P 1/165* (2013.01); *H01P 1/171* (2013.01); *H01Q 15/242* (2013.01); *H01Q 15/246* (2013.01)

(58) Field of Classification Search

CPC ..... H01P 1/165; H01P 1/171; H01Q 13/00; H01Q 15/246

USPC ..... 333/21 A, 21 R; 343/700 MS, 756, 771, 343/786

See application file for complete search history.

(56) References Cited

U.S. PATENT DOCUMENTS

| | | | | |
|---|---|---|---|---|
| 2,425,345 | A | 8/1947 | Ring | |
| 2,574,433 | A * | 11/1951 | Clapp | H01Q 21/0043 333/248 |
| 2,809,354 | A | 10/1952 | Allen | |
| 3,287,729 | A | 11/1966 | Mark et al. | |
| 3,924,205 | A * | 12/1975 | Hansen | H01P 1/161 333/125 |
| 4,375,052 | A | 2/1983 | Anderson | |
| 4,672,334 | A | 6/1987 | Saad | |
| 4,755,828 | A * | 7/1988 | Grim | H01P 1/165 333/21 A |
| 5,107,274 | A * | 4/1992 | Mitchell | H01P 1/165 333/135 |
| 5,576,668 | A | 11/1996 | Clark et al. | |
| 8,077,103 | B1 * | 12/2011 | Acosta | H01Q 1/288 333/21 A |
| 8,933,855 | B2 * | 1/2015 | Nelson | H01P 1/171 333/21 A |

* cited by examiner

*Primary Examiner* — Tho G Phan
(74) *Attorney, Agent, or Firm* — Kramer & Amado, P.C.

(57) ABSTRACT

Various exemplary embodiments relate to an antenna feed configured to receive a signal having a wavelength. They antenna feed may include a cylindrical body and four pin groups. Each pin group may include two pins in close proximity extending across the center of the cylindrical body. One of the two pins may be rotated approximately 22.5° from the angle of the other pin. Each pin group may be spaced approximately one quarter of a wavelength away from each other, and may be rotated approximately 22.5° from the angle of the previous pin group.

14 Claims, 3 Drawing Sheets

ANTENNA FEED WITH POLARIZATION ROTATION

TECHNICAL FIELD

Various exemplary embodiments disclosed herein relate generally to antennas and orthomode couplers.

BACKGROUND

An antenna is a device that may be used to transmit or receive electromagnetic waves. The electromagnetic waves may be signals that carry information. The antenna may receive a signal by collecting electromagnetic waves in an electrical mode of a transmission line. The antenna may transmit a signal by converting the transmission line electrical mode into electromagnetic waves in free space. Antennas often use waveguides to transmit the electromagnetic waves. The electromagnetic waves have a polarization that may need to be known and controlled. Antennas may be vertically or horizontally polarized with respect to earth. The two polarizations may need to be separated or isolated from each other because they may contain different signals or information. In the case of high density antennas, the antenna feed may include two waveguides attached to an antenna feed horn. The waveguides may be bent in the same plane to minimize antenna pattern distortions. The waveguides may have additional bends to attach the waveguides to the feed in a way that accepts two orthogonal polarizations. Accordingly, there is a need to rotate the polarization of electromagnetic waves in a feed while minimizing the loss and size of the antenna feed horn, while also providing a large bandwidth of operation.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of exemplary embodiments adequate to allow those of ordinary skill in the art to make and use the inventive concepts will follow in later sections.

Various exemplary embodiments relate to an antenna feed configured to receive a signal having a wavelength, including: a cylindrical body; a first pin group including a first pin extending across the center of the cylindrical body at a first angle, and a second pin extending across the center of the cylindrical body at an angle rotated approximately 22.5° from the angle of the first pin, wherein the first and second pins of the first pin group are spaced in close proximity; a second pin group including a third pin extending across the center of the cylindrical body at an angle approximately equal to the angle of the second pin of the first pin group, and a fourth pin extending across the center of the cylindrical body at an angle rotated approximately 22.5° from the angle of the third pin, wherein the third and fourth pins of the second pin group are spaced in close proximity, and wherein the second pin group is spaced approximately one quarter of a wavelength away from the first pin group; a third pin group including a fifth pin extending across the center of the cylindrical body at an angle approximately equal to the angle of the fourth pin of the second pin group, and a sixth pin extending across the center of the cylindrical body at an angle rotated approximately 22.5° from the angle of the fifth pin, wherein the fifth and sixth pins of the third pin group are spaced in close proximity, and wherein the third pin group is spaced approximately one quarter of a wavelength away from the second pin group; and a fourth pin group including a seventh pin extending across the center of the cylindrical body at an angle approximately equal to the angle of the sixth pin of the third pin group, and an eighth pin extending across the center of the cylindrical body at an angle rotated approximately 22.5° from the angle of the seventh pin, wherein the seventh and eighth pins of the fourth pin group are spaced in close proximity, and wherein the fourth pin group is spaced approximately one quarter of a wavelength away from the third pin group.

In some embodiments, the antenna feed further includes: a first pair of capacitive tuning probes in line with the first pin group and rotated approximately 90° from the angle of the second pin, wherein each probe in the first pair of capacitive tuning probes are arranged on opposite sides of the cylindrical body; a second pair of capacitive tuning probes in line with the second pin group and rotated approximately 90° from the angle of the fourth pin, wherein each probe in the second pair of capacitive tuning probes are arranged on opposite sides of the cylindrical body; a third pair of capacitive tuning probes in line with the third pin group and rotated approximately 90° from the angle of the sixth pin, wherein each probe in the third pair of capacitive tuning probes are arranged on opposite sides of the cylindrical body; and a fourth pair of capacitive tuning probes in line with the fourth pin group and rotated approximately 90° angle of the from the eighth pin, wherein each probe in the fourth pair of capacitive tuning probes are arranged on opposite sides of the cylindrical body.

Various exemplary embodiments further relate to an antenna feed configured to receive a signal having a wavelength, including: a cylindrical body; a series of pin groups extending across the center of the cylindrical body, wherein the series of pin groups are spaced at approximately equal distances and rotated an approximately equal number of degrees, and wherein the series of pin groups extend along a length of the cylindrical body for a distance of less than one wavelength of the signal; and a series of capacitive tuning probes, wherein the series of capacitive tuning probes are aligned with the series of pin groups and are rotated approximately 90° from the series of pin groups.

In some embodiments, the antenna feed rotates the polarization of the signal by approximately 90°. In some embodiments, the antenna feed rotates a horizontally polarized signal to a vertically polarized signal. In some embodiments, the antenna feed rotates a vertically polarized signal to a horizontally polarized signal. In some embodiments, the antenna feed rotates the polarization of the signal over a length of three quarters of wavelength. In some embodiments, the antenna feed rotates the polarization of the signal over a length of less than one wavelength.

BRIEF DESCRIPTION OF THE DRAWINGS

In order to better understand various exemplary embodiments, reference is made to the accompanying drawings, wherein.

DETAILED DESCRIPTION

Figure 1:
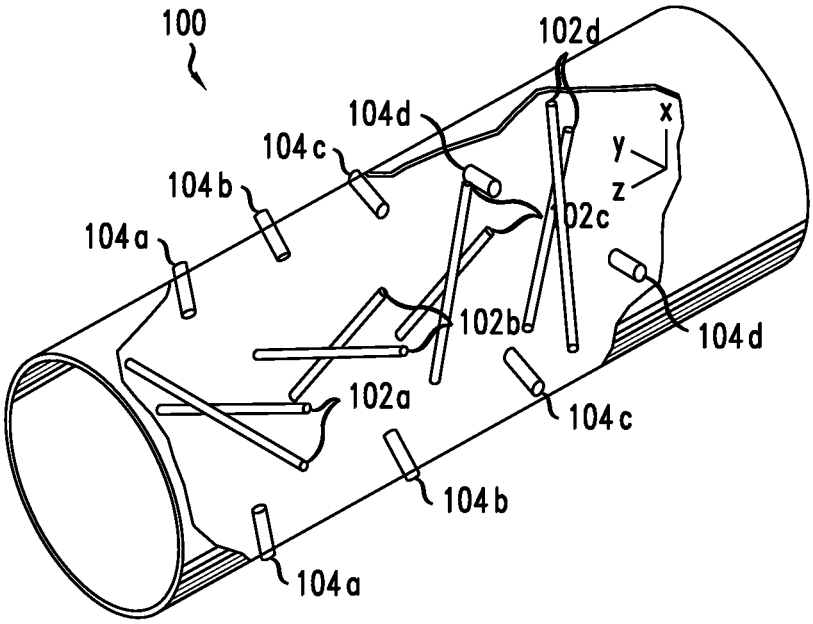
FIG. 1 illustrates a perspective view of an embodiment of an antenna feed.

Referring now to the drawings, in which like numerals refer to like components or steps, there are disclosed broad aspects of various exemplary embodiments.

Antenna feeds may rotate a polarization of a signal. The polarization may be rotated using various devices and methods. For example, a signal may be rotated 90° by using a series of rotating pins inside of the antenna feed, as shown in U.S. Pat. No. 3,924,205, hereby incorporated by reference. The conventional pins may be spaced at close intervals that are much smaller than the wavelength of the signal. The conventional pins may also be rotated a small number of degrees. The conventional pins may be rotated over a length of one wavelength or more, making the length of the antenna feed longer than one wavelength.

FIG. 1 illustrates a perspective view of an embodiment of an antenna feed 100. The feed 100 may be configured to operate with a signal at specific frequencies. The feed 100 may have a cylindrically shaped wall 101. The feed 100 may include four pin groups 102*a*-102*d*. Each pin group 102*a*-102*d* may include at least two pins rotated axially approximately 22.5° from each other. The two pins in each pin group 102*a*-102*d* may be spaced in close proximity to each other to form an approximate "X" shape. Each of the pin groups 102*a*-102*d* may extend across the center of the feed 100 and may attach to the wall 101. The first pin group 102*a* may be at a first angle, for example 0°. The second pin group 102*b* may be rotated approximately 22.5° from the first pin group 102*a*. One pin of the second pin group 102*b* may be at approximately the same angle as one pin of the first pin group 102*a*. The third pin group 102*c* may be rotated approximately 22.5° from the second pin group 102*b*, or approximately 45° from the first pin group 102*a*. One pin of the third pin group 102*c* may be at approximately the same angle as one pin of the second pin group 102*b*. The fourth pin group 102*d* may be rotated approximately 22.5° from the third pin group 102*b*, or approximately 67.5° from the first pin group 102*a*. One pin of the fourth pin group 102*d* may be at approximately the same angle as one pin of the third pin group 102*c*. All of the pin groups 102*a*-102*d* may be rotated in the same direction, either clockwise or counterclockwise. The 22.5° rotation in the pin groups 102*a*-102*d* may provide a 90° rotation in the polarization of the signal. For example, an input signal with vertical polarization may be rotated 90° and output with horizontal polarization. Alternatively, an input signal with horizontal polarization may be rotated 90° and output with vertical polarization.

The feed 100 may further include four pairs of capacitive tuning probes 104*a*-104*d*. The four pairs of capacitive tuning probes 104*a*-104*d* may correspond with each of the four pin groups 102*a*-102*d*. The first pair of capacitive tuning probes 104*a* may be rotated approximately 90° from the first pin group 102*a*. The second pair of capacitive tuning probes 104*b* may be rotated approximately 90° from the second pin group 102*b*. The third pair of capacitive tuning probes 104*c* may be rotated approximately 90° from the third pin group 102*c*. The fourth pair of capacitive tuning probes 104*d* may be rotated approximately 90° from the fourth pin group 102*d*. The four pairs of capacitive tuning probes 104*a*-104*d* may improve the bandwidth of the feed 100 by cancelling an inductive mismatch caused by the polarization rotation of the four pin groups 102*a*-102*d*.

Figure 2:
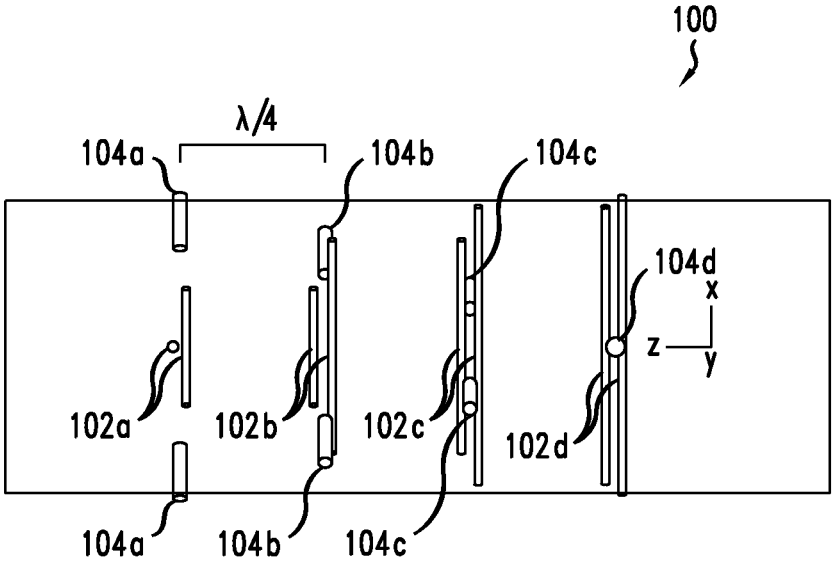
FIG. 2 illustrates a side view of an embodiment of the antenna feed.

FIG. 2 illustrates a side view of an embodiment of the antenna feed 100. The first pair of capacitive tuning probes 104*a* may be in line with the first pin group 102*a*. The second pair of capacitive tuning probes 104*b* may be in line with the second pin group 102*b*. The third pair of capacitive tuning probes 104*c* may be in line with the third pin group 102*c*. The fourth pair of capacitive tuning probes 104*d* may be in line with the fourth pin group 102*d*. The two pins of each pin group 102*a*-102*d* may be spaced in close proximity to each other. Each of the four pin groups 102*a*-102*d* and four pairs of capacitive tuning probes 104*a*-104*d* may be spaced apart a distance approximately equal to one quarter of the wavelength of the signal.

By spacing the pin groups 102*a*-102*d* at quarter length intervals, fewer pins may be required than with a conventional antenna feed. Additionally, the feed 100 may have a shorter length than a conventional antenna feed. The feed 100 may rotate the polarization of a signal 90° over a length of only three quarters of a wavelength, while a conventional antenna feed may perform the rotation over a length of one wavelength or more. Additionally, by using only four pin groups in combination with the capacitive tuning screws, the feed 100 may have a greater bandwidth than a conventional antenna feed. Further, the use of four pin groups reduces complexity and the cost of manufacturing.

Figure 3:
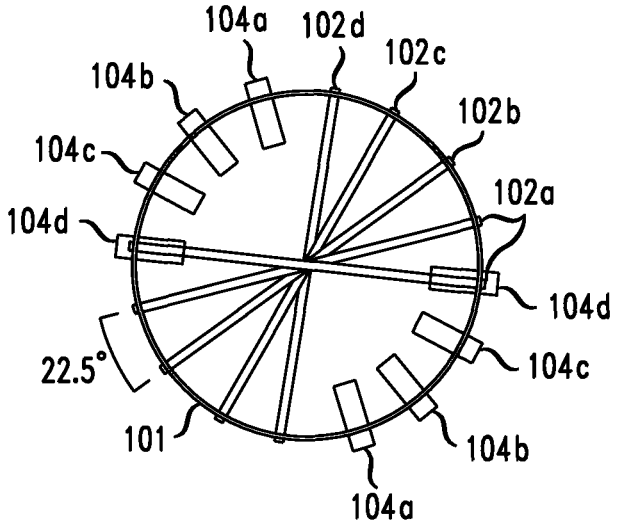
FIG. 3 illustrates an end view of an embodiment of the feed.

FIG. 3 illustrates an end view of an embodiment of the feed 100. The first pin group 102*a* may include two pins rotated axially approximately 22.5°. The second pin group 102*b* may be rotated axially approximately 22.5° from the first pin group 102*a*. The second pin group 102*b* may include two pins rotated axially approximately 22.5°. One pin of the second pin group 102*b* may be at the same angle as one pin of the first pin group 102*a* and may be hidden by the first pin group 102*a* when the feed 100 is viewed on end as in FIG. 3. The third pin group 102*c* may be rotated axially approximately 22.5° from the second pin group 102*b*. The third pin group 102*c* may include two pins rotated axially approximately 22.5°. One pin of the third pin group 102*c* may be at the same angle as one pin of the second pin group 102*b* and may be hidden by the second pin group 102*b* when the feed 100 is viewed on end as in FIG. 3. The fourth pin group 102*d* may be rotated axially approximately 22.5° from the third pin group 102*c*. The fourth pin group 102*d* may include two pins rotated axially approximately 22.5°. One pin of the fourth pin group 102*d* may be at the same angle as one pin of the third pin group 102*d* and may be hidden by the third pin group 102*d* when the feed 100 is viewed on end as in FIG. 3. The 22.5° rotation in the pin groups 102*a*-102*d* may provide a 90° rotation in the polarization of the signal. For example, an input signal with vertical polarization may be rotated 90° and output with horizontal polarization. Alternatively, an input signal with horizontal polarization may be rotated 90° and output with vertical polarization.

As shown in FIG. 3, the first pair of capacitive tuning probes 104*a* may be rotated approximately 90° from one pin of the first pin group 102*a*, or 112.5° from the other pin of the first pin group 102*a*. The second pair of capacitive tuning probes 104*b* may be rotated approximately 90° from one pin of the second pin group 102*b*, or 112.5° from the other pin of the second pin group 102*b*. The third pair of capacitive tuning probes 104*c* may be rotated approximately 90° from one pin of the third pin group 102*c*, or 112.5° from the other pin of the third pin group 102*c*. The fourth pair of capacitive tuning probes 104*d* may be rotated approximately 90° from one pin of the fourth pin group 102*d*, or 112.5° from the other pin of the fourth pin group 102*d*. The four pairs of capacitive tuning probes 104*a*-104*d* may extend outside of the wall 101 of the feed 100 to allow for adjustment of the tuning probes. The four pairs of capacitive tuning probes 104*a*-104*d* may improve the bandwidth of the feed 100 by cancelling an inductive mismatch caused by the polarization rotation of the four pin groups 102*a*-102*d*.

It is noted that while four pin groups with approximately 22.5° rotation between adjacent pin groups is illustrated, other numbers of pins and rotations may be used as well. For example, five pin groups with 18° of rotation between adjacent pin groups may be used that are spaced apart along the length of the waveguide by about one fifth of the wavelength. Any combination of the number of pins and the desired polarization rotation may be selected along with a spacing that leads to a length of less than one wavelength. The number and spacing of the associated capacitive probes will be selected to correspond to the number and position of the pins.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. An antenna feed configured to receive a signal having a wavelength, comprising:

a cylindrical body having an axis and a circumference;

a plurality of pins, each pin extending from one side of the cylindrical body to an opposite side of the cylindrical body and intersecting the axis, wherein the plurality of pins is organized as a series of pin pairs, each pin pair comprising two adjacent pins having a same fixed angle therebetween and located at a position along said axis, a spacing between pins in a pin pair is much smaller than a spacing between pins of adjacent pin pairs, and the pin pairs are spaced along the axis at approximately equal distances relative to adjacent pin pairs, and each pin pair is rotated around the axis by an approximately equal number of degrees with respect to adjacent pin pairs; and a plurality of capacitive tuning probes arranged in probe pairs, wherein probes of each probe pair pass through opposing sides of the cylindrical body at about a same position along the axis as a corresponding pin pair and at locations on the circumference offset by approximately 90° from one of the pins of the corresponding pin pair.

2. The antenna feed of claim 1, wherein the plurality of pins and plurality of tuning probes are configured to rotate a polarization of the signal by approximately 90°.

3. The antenna feed of claim 1, wherein plurality of pins and plurality of tuning probes are configured to rotate a received horizontally polarized signal to a vertically polarized signal.

4. The antenna feed of claim 1, wherein plurality of pins and plurality of tuning probes are configured to rotate a received vertically polarized signal to a horizontally polarized signal.

5. The antenna feed of claim 1, wherein the antenna feed is configured to provide a 90° rotation of a polarization of the signal over a length of approximately three quarters of the wavelength.

6. The antenna feed of claim 1, wherein the antenna feed is configured to provide a 90° rotation of a polarization of the signal over a length of less than the wavelength.

7. The antenna feed of claim 1, wherein all of the pins are located within a length of the cylindrical body that is less than the wavelength of the signal.

8. The antenna feed of claim 1, wherein all of the pins are located within a length of the cylindrical body that is no greater than about three-quarters of the wavelength of the signal.

9. The antenna feed of claim 1, wherein the fixed angle is about 18°.

10. The antenna feed of claim 1, wherein the fixed angle is about 22.5°.

11. An antenna feed configured to receive a signal having a wavelength, comprising:

a cylindrical body;

a first pin group including a first pin extending across the center of the cylindrical body, and a second pin extending across the center of the cylindrical body forming an angle approximately 18° relative to the first pin, wherein the first and second pins of the first pin group are spaced in close proximity;

a second pin group including a third pin extending across the center of the cylindrical body about parallel to the second pin of the first pin group, and a fourth pin extending across the center of the cylindrical body rotated approximately 18° relative to the third pin, wherein the third and fourth pins of the second pin group are spaced in close proximity, and wherein the second pin group is spaced approximately one fifth of the wavelength away from the first pin group;

a third pin group including a fifth pin extending across the center of the cylindrical body about parallel to the fourth pin of the second pin group, and a sixth pin extending across the center of the cylindrical body rotated approximately 18° relative to the fifth pin, wherein the fifth and sixth pins of the third pin group are spaced in close proximity, and wherein the third pin group is spaced approximately one fifth of the wavelength away from the second pin group;

a fourth pin group including a seventh pin extending across the center of the cylindrical body about parallel to the sixth pin of the third pin group, and an eighth pin extending across the center of the cylindrical body rotated approximately 18° relative to the seventh pin, wherein the seventh and eighth pins of the fourth pin group are spaced in close proximity, and wherein the fourth pin group is spaced approximately one fifth of a wavelength away from the third pin group;

a fifth pin group including a ninth pin extending across the center of the cylindrical body relative to the eighth pin of the fourth pin group, and a tenth pin extending across the center of the cylindrical body rotated approximately 18° relative to the ninth pin, wherein the ninth and tenth pins of the fifth pin group are spaced in close proximity, and wherein the fifth pin group is spaced approximately one fifth of a wavelength away from the fourth pin group.

12. The antenna feed of claim 11, further comprising:

a first pair of capacitive tuning probes in line with the first pin group and rotated approximately 90° from the angle of the second pin, wherein the probes in the first pair of capacitive tuning probes are arranged on opposite sides of the cylindrical body;

a second pair of capacitive tuning probes in line with the second pin group and rotated approximately 90° from the angle of the fourth pin, wherein the probes in the second pair of capacitive tuning probes are arranged on opposite sides of the cylindrical body;

a third pair of capacitive tuning probes in line with the third pin group and rotated approximately 90° from the angle of the sixth pin, wherein the probes in the third pair of capacitive tuning probes are arranged on opposite sides of the cylindrical body;

a fourth pair of capacitive tuning probes in line with the fourth pin group and rotated approximately 90° angle of the from the eighth pin, wherein the probes in the fourth pair of capacitive tuning probes are arranged on opposite sides of the cylindrical body; and a fifth pair of capacitive tuning probes in line with the fifth pin group and rotated approximately 90° angle of the from the tenth pin, wherein the probes in the fifth pair of capacitive tuning probes are arranged on opposite sides of the cylindrical body.

13. An antenna feed configured to receive a signal having a wavelength, comprising:

a cylindrical body;

four pin groups, each pin group comprising two pins forming an angle of approximately 22.5° therebetween, a second pin group of the four pin groups rotated axially approximately 22.5° from a first pin group of the four pin groups and comprising one pin about parallel to one pin of the first pin group, a third pin group of the four pin groups rotated axially approximately 22.5° from the second pin group and comprising one pin about parallel to one pin of the second pin group, and a fourth pin group of the four pin groups rotated axially approximately 22.5° from the third pin group and comprising one pin about parallel to one pin of the third pin group, wherein the antenna feed is configured by the four pin groups to rotate the polarization of the signal about 90°.

14. The antenna feed of claim 13, further comprising:

a first pair of capacitive tuning probes arranged on opposite sides of the cylindrical body and having a common axis that is rotated about 90° relative to one pin of the first pin group;

a second pair of capacitive tuning probes arranged on opposite sides of the cylindrical body and having a common axis that is rotated about 90° relative to one pin of the second pin group;

a third pair of capacitive tuning probes arranged on opposite sides of the cylindrical body and having a common axis that is rotated about 90° relative to one pin of the third pin group; and a fourth pair of capacitive tuning probes arranged on opposite sides of the cylindrical body and having a common axis that is rotated about 90° relative to one pin of the fourth pin group.

* * * * *